US006222144B1

(12) United States Patent
Nishikawa

(10) Patent No.: US 6,222,144 B1
(45) Date of Patent: Apr. 24, 2001

(54) PUSHBUTTON SWITCH

(75) Inventor: Kikuyoshi Nishikawa, Yokohama (JP)

(73) Assignee: Sagami Electric Company, Kanagawa (JP)

( * ) Notice: Subject to any disclaimer, the term of this patent is extended or adjusted under 35 U.S.C. 154(b) by 0 days.

(21) Appl. No.: 09/521,207

(22) Filed: Mar. 8, 2000

(30) Foreign Application Priority Data

Mar. 18, 1999 (JP) ..... 11-073127

(51) Int. Cl.[7] ..... H01H 15/00

(52) U.S. Cl. ..... 200/537; 200/6 R; 200/16 D; 200/553

(58) Field of Search ..... 200/6 R, 6 BB, 200/16 R–16 D, 520, 530, 531, 532, 533, 536, 553, 558, 559, 561, 562, 563, 339, 341, 343

(56) References Cited

U.S. PATENT DOCUMENTS 5,142,113 * 8/1992 Miyata ..... 200/559
5,278,370 * 1/1994 Miyata et al. ..... 200/244
5,667,062 * 9/1997 Yasufuku et al. ..... 200/536
5,796,058 * 8/1998 Aimi et al. ..... 200/16 D

* cited by examiner

*Primary Examiner*—Michael Friedhofer
(74) *Attorney, Agent, or Firm*—Connolly Bove Lodge & Hutz, LLP

(57) ABSTRACT

A pushbutton switch is formed by: an insulating body molded of an insulating material and into a box-like shape having an opening at on end, a pair of fixed contact pieces to be electrically connected to and disconnected from each other being embedded in the inner bottom surface of the box-shaped insulating body; a rotary actuator rotatably supported at one end in the insulating body and formed at the other end as a unitary structure with a push button which projects out of the insulating body; and a plate spring formed by a retaining contact piece engaged at one end with the free end of the rotary actuator and a movable contact piece sliding at one end on the inner bottom surface and coupled at the other end with the retaining contact piece in such a manner as to define a V-letter shape between them, the plate spring resiliently biasing by the reaction force from the inner bottom surface of the insulating body the push button in the direction in which it projects out through the opening of the insulating body.

7 Claims, 7 Drawing Sheets

PUSHBUTTON SWITCH

BACKGROUND OF THE INVENTION

The present invention relates to a pushbutton switch that can be used to detect whether a portable telephone, notebook PC, or similar miniature electronic equipment is open or closed.

Heretofore, switches called limit switches have widely been used as "open" and "closed" position detectors for electronic equipment. Many of the limit switches utilize the snap action of a spring contact to drive a movable contact.

The conventional limit switches are so complex in their contact driving mechanism that they cannot be miniaturized. Besides, because of large stroke lengths required for the switching operation of the actuator (a pushbutton), they are not suitable for use as switches to detect the open/closed position of small-sized electronic equipment such as a portable telephone or notebook PC.

SUMMARY OF THE INVENTION

It is therefore an object of the present invention to provide a pushbutton switch that is small-sized and short in the pushbutton stroke length and hence is suitable for use as a switch to detect the open/closed position of a portable telephone or notebook PC.

Another object of the present invention is to provide a pushbutton switch that can be turned ON and OFF with a light force and hence is highly durable.

The pushbutton switch according to the present invention comprises: an insulating body molded of an insulating material and having a box-like shape consisting of a pair of opposed side panels, a pair of opposed front and rear panels and a bottom panel, said insulating body having an opening at one end, and a pair of contact pieces to be electrically connected to and disconnected from each other being embedded in the inner bottom surface of said bottom panel of said insulating body;

a rotary actuator rotatably held at one end in said insulating body at a position higher than said inner bottom surface and carrying at the other end a push button projecting outwardly of said insulating body;

a plate spring having a retaining contact piece engaged at one end with the free end of said rotary actuator and a movable contact piece for sliding at one end into or out of contact with said pair of fixed contact pieces on said inner bottom surface of said bottom panel of said insulating body, said retaining contact piece and said movable contact piece being coupled together at the other end to form a V-letter shape, and said plate spring being disposed between said rotary actuator and said inner bottom surface of said bottom panel and resiliently biasing by reaction force from said inner bottom surface the free end portion of said rotary actuator in a direction in which to project out said push button from said opening of said insulating body; and a cover covering said opening of said insulating body but having a window through which said push button projects out of said insulating body.

According to the present invention, since the movable contact piece slides into or out of contact with the fixed contact piece on the inner bottom surface of the insulating body, it does not undergo severe elastic deformation. Accordingly, the present invention offers a pushbutton switch that permits ON-OFF control between contacts with a light force and is almost free from breakage.

DETAILED DESCRIPTION THE PREFERRED EMBODIMENTS

In FIGS. 1 through 4 there is illustrated an embodiment of the pushbutton switch according to the present invention.

Figure 1:
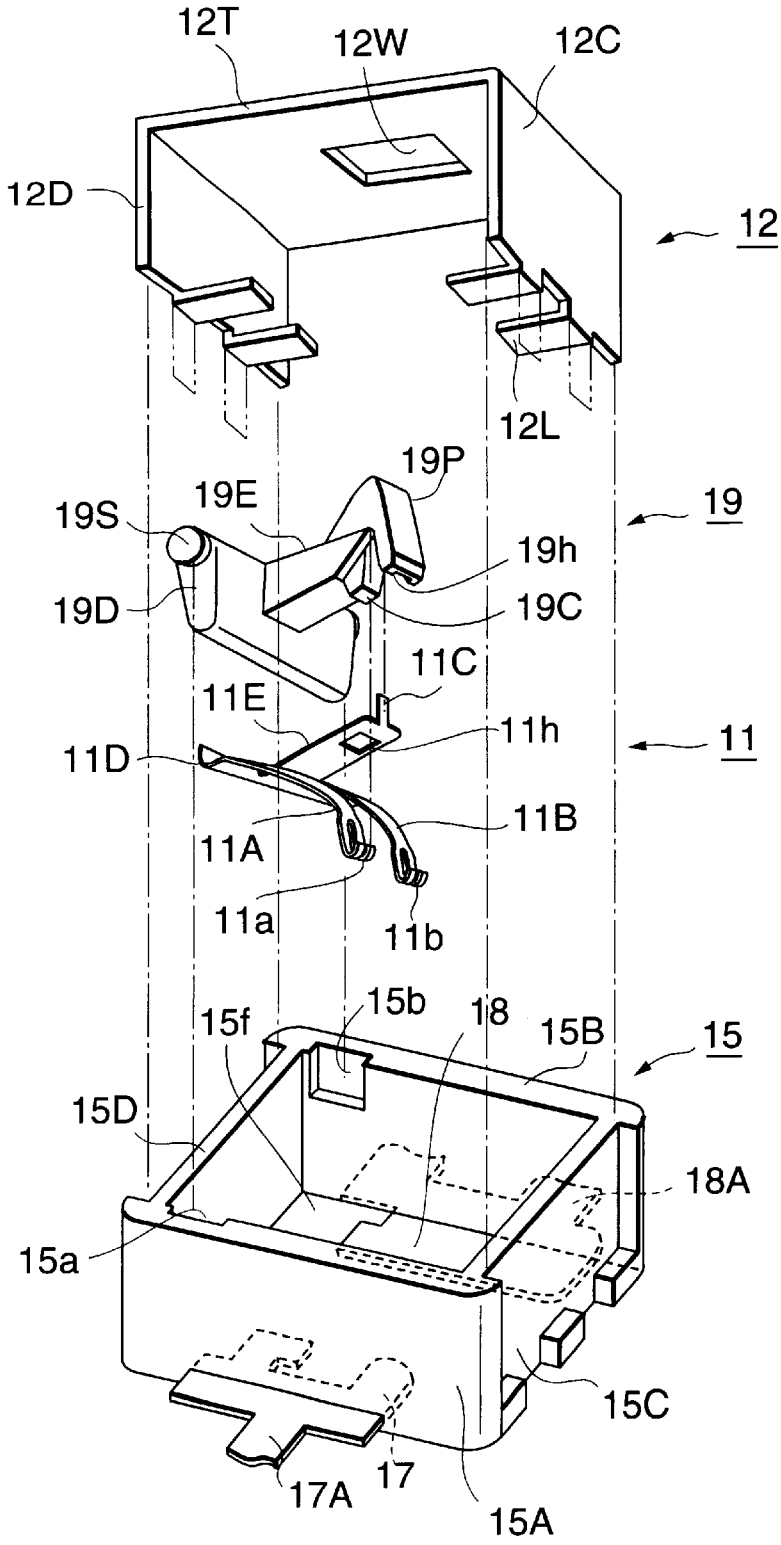
FIG. 1 is an exploded perspective view of a pushbutton switch according to the present invention.

As seen from its exploded perspective view shown in FIG. 1, the pushbutton switch of the present invention comprises: a substantially rectangular box-shaped insulating body 15; a plate spring 11 placed in the body 15 and bent into a V-letter shape; a rotary actuator 19; and a metal cover 12 that closes the upper open end of the body 15, covers its front and rear panels 15C and 15D and is bent in contact with its underside.

Figure 2A:
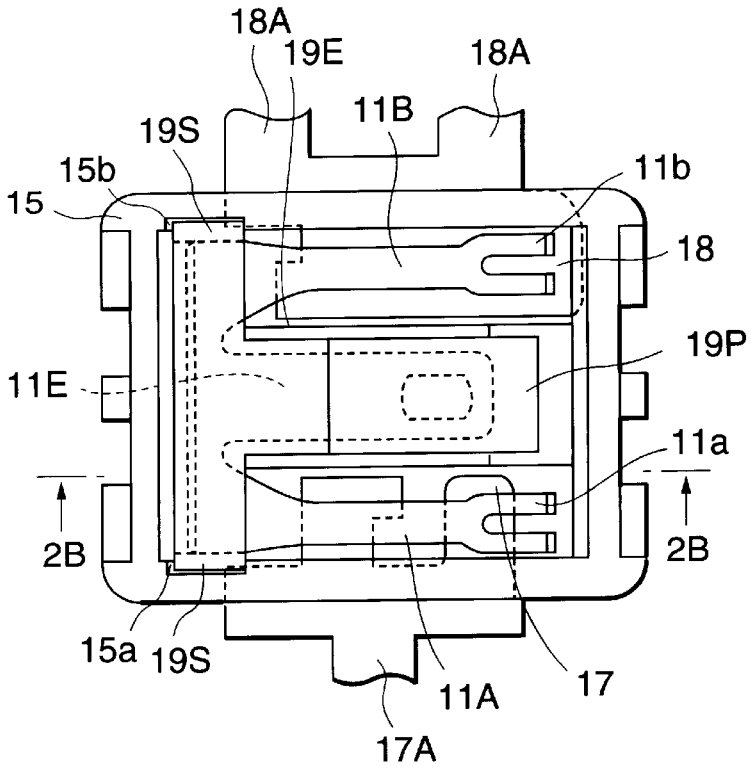
FIG. 2A is a plan view of the pushbutton switch with its metal cover 12 taken off.
Figure 2B:
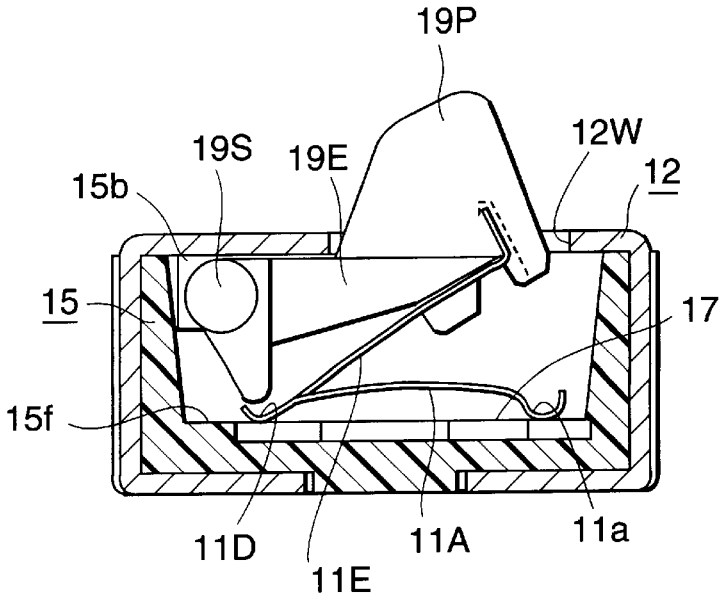
FIG. 2B is a sectional view taken along the line 2B—2B in FIG. 2A.

FIG. 2A is a plan view of the pushbutton switch with the metal cover 12 removed. FIG. 2B is a sectional view taken along the line 2B—2B in FIG. 2A, showing the state in which a push button 19P formed integrally with the rotary actuator 19 is at its outermost position.

Figure 3A:
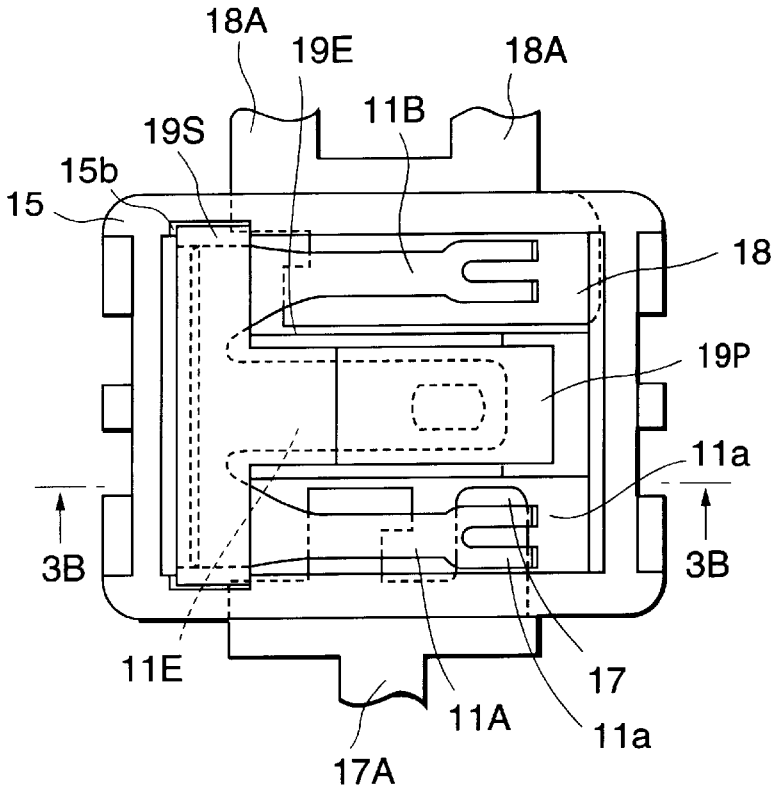
FIG. 3A is a plan view of the pushbutton switch, for explaining the state of its actuation.
Figure 3B:
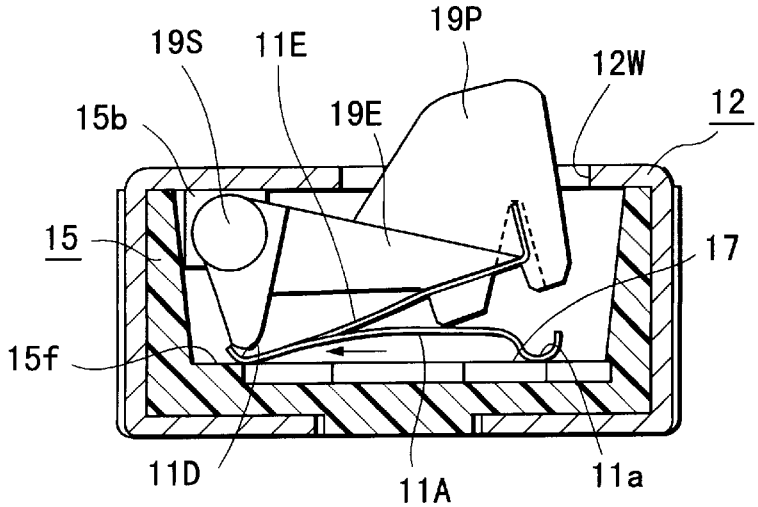
FIG. 3B is a sectional view taken along the line 3B—3B in FIG. 3A.
Figure 4A:
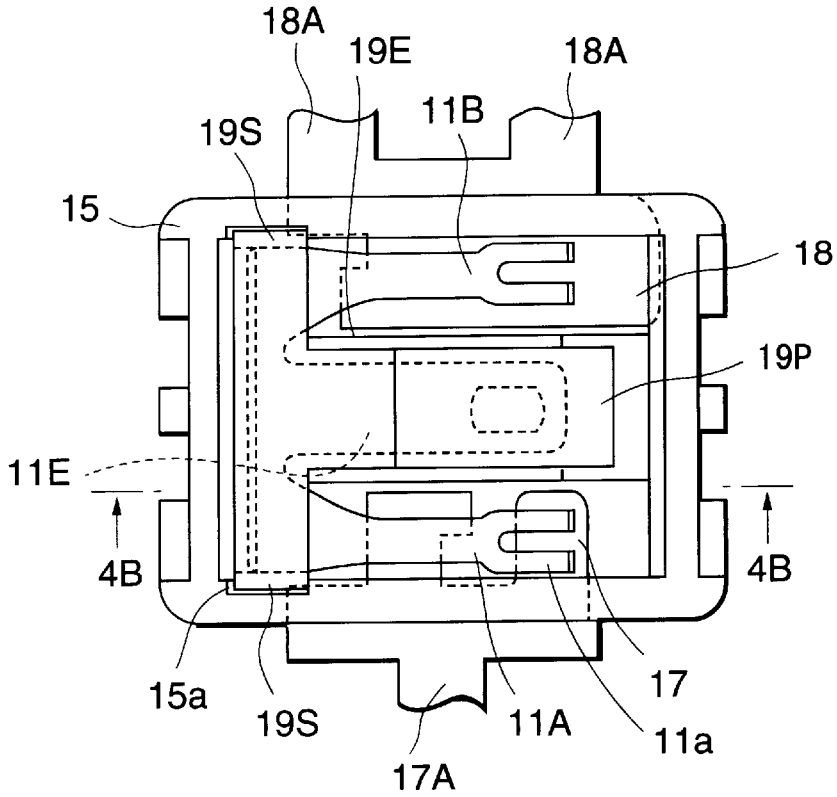
FIG. 4A is a plan view of the pushbutton switch, for explaining its ON state.
Figure 4B:
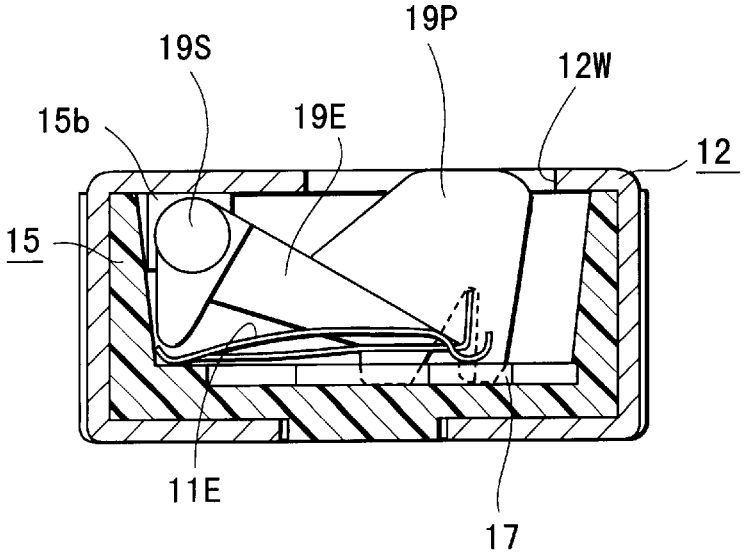
FIG. 4B is a sectional view taken along the line 4B—4B in FIG. 4A.

FIGS. 2A and 2B depict the state in which terminals 17A and 18A are electrically isolated from each other with the push button 19P at its outermost position. FIGS. 3A and 3B depict, in correspondence with FIGS. 2A and 2B, the state in which the push button 19P is pressed halfway into the insulating body 15. FIGS. 4A and 4B illustrate, in correspondence with FIGS. 2A and 2B, the state in which the push button 19P is fully pressed into the insulating body 15.

The insulating body 15 is a box-like container that has a substantially rectangular bottom panel 15F, the front and rear panels 15C and 15D opposed across the bottom panel 15F, and both side panels 15A and 15B opposed across the bottom panel 15F. In the formation of the insulating body 15 fixed contact pieces 17 and 18 are inserted therein and molded therewith so that they are flush with the upper surface of the bottom panel 15F (hereinafter referred to also as the inner bottom surface of the insulating body) and that the terminals 17A and 18A extended from the fixed contact pieces 17 and 18 project out of the side panels 15A and 15B, respectively. In inner wall surfaces of the opposed side panels 15A and 15B of the insulating body 15 there are formed bearing recesses 15*a* and 15*b* which communicate with the upper end faces of the side panels 15A and 15B in close proximity to the rear panel 15D.

The metal cover 12 is made of stamped sheet metal bent into the required shape. The cover 12 comprises: a substantially rectangular top panel 12T; front and rear panels 12C and 12D bent downward from a pair of opposed marginal edges of the top panel 12T; and retaining lugs 12L which are extended from the lower marginal edges of the front and rear panels 12C and 12D and bent inward after the assembling of the switch. The top panel 12T has a window 12W which extends from its center toward the front panel 12C and through which the push button 19P of the rotary actuator 19 protrudes beyond the top panel 12T.

Figure 5A:
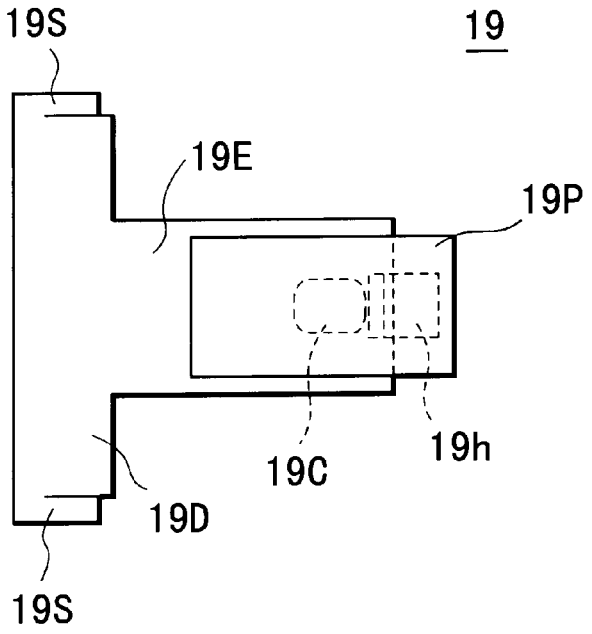
FIG. 5A is a plan view explanatory of a rotary actuator 19 for use in the present invention.
Figure 5B:
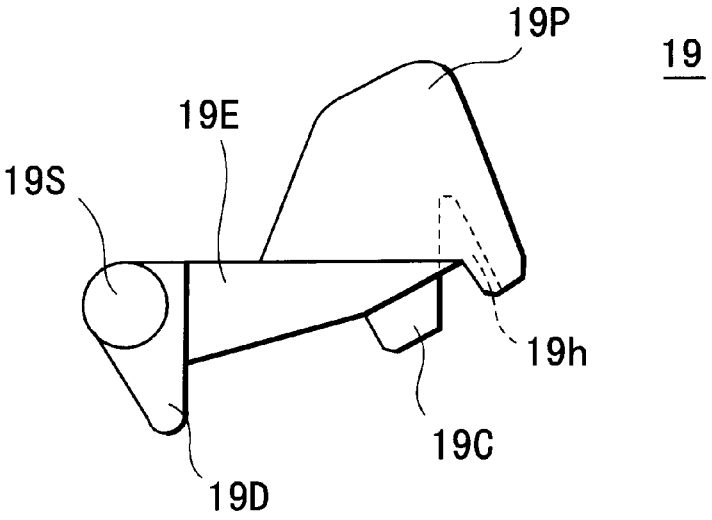
FIG. 5B is its side view.

The rotary actuator 19 comprises, as depicted in FIGS. 1, 5A and 5B, a rotary plate 19D having at its opposite ends circular rotary shaft portions 19S, a lever portion 19E extended from the center of the rotary plate 19D substantially at right angles to the surface thereof, the push button 19P formed integrally with the lever portion 19E on the top of its free end portion, an engaging hole 19*h* made in the underside of the free end of the push button 19P, and an engaging projection 19C formed integrally with the rotary plate 19D on the underside thereof adjacent to the hole 19*h*.

Figure 6A:
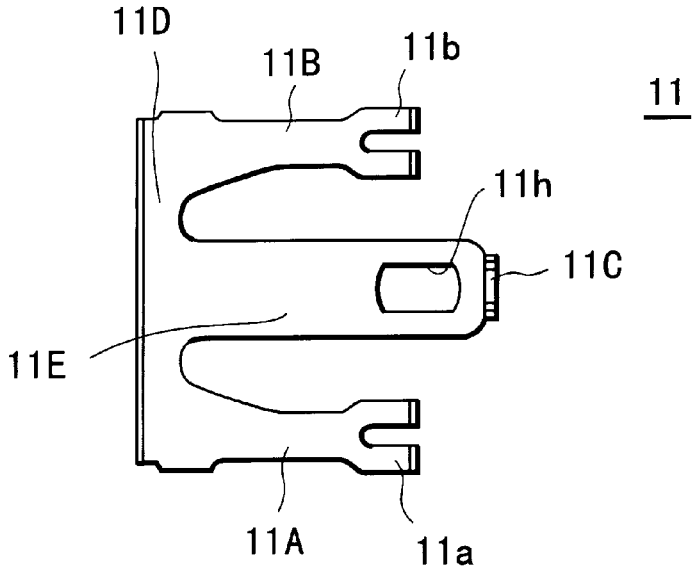
FIG. 6A is a plan view explanatory of a plate spring for use in the present invention.
Figure 6B:
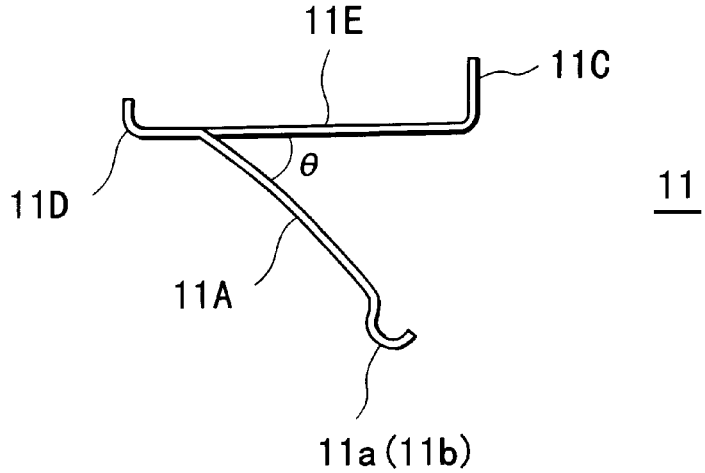
FIG. 6B is its side view.

The plate spring 11 is formed by stamping a spring metal sheet into an E-letter shape as shown in FIG. 6A and bending downward both side movable contact pieces 11A and 11B relative to the middle retaining contact piece 11E so that they form substantially a V-letter shape as viewed from the direction normal to the plane of the paper in FIG. 6B. The movable contact pieces 11A and 11B have at their tip movable contacts 11*a* and 11*b* which slide into or out of contact with the fixed contact pieces 17 and 18. In this embodiment, with a view to increasing the number of points of contact with the fixed contact pieces 17 and 17, the tip end portions of the movable contact pieces 11A and 11B are bifurcated to provide the movable contacts 11*a* and 11*b*. The movable contacts 11*a* and 11*b* are each formed convex with respect to the inner bottom surface 15*f* of the insulating body 15 for smooth sliding movement thereon. The base portion 11D of the plate spring 11, which couples the both side movable contact pieces 11A and 11B and the middle retaining contact piece 11E, is bent into a circular arc of approximately 90 degrees about an axis parallel to the marginal edge of the base portion 11D to provide increased mechanical strength in its lengthwise direction and to assure smooth sliding movement of the plate spring 11 on the inner bottom surface of the insulating body 15.

The retaining contact piece 11E has an engaging hole 11*h* made therein near its extremity and has its free end portion bent upward at right angles to form a fixing lug 11C. The fixing lug 11 is guided into the guide hole 19*h* of the level portion 19E of the rotary actuator 19, then the engaging projection 19C of the rotary actuator 19 is fitted into the engaging hole 11*h*. The opposite rotary shaft portions 19S of the rotary plate 19D are rotatably supported in the bearing recesses 15*a* and 15*b* formed in the both side panels 15A and 15B of the insulating body 15. As a result, the retaining contact piece 11E extends backward (toward the rear panel 15D) at an angle to the underside of the level portion 19E, and the movable contact pieces 11A and 11B extend from the base portion 11D forwardly thereof toward the inner surface of the bottom panel 15D. The lengths of the retaining contact piece 11E and the movable contact pieces 11A and 11B are chosen to be substantially equal to, for example, the length of the lever portion 19E. The width of the retaining contact piece 11E is about twice larger than the widths of the movable contact pieces 11A and 11B.

When the rotary actuator 19 assembled with the plate spring 11 is mounted in the insulating body 15 with the opposite rotary shaft portions 19S held in the bearing recesses 15*a* and 15*b*, the movable contacts 11*a* and 11*b* are pressed against the inner bottom surface 15*f* and the push button 19P protrudes upwardly of the upper end face of the insulating body 15. The switch is assembled by pressing the push button 19P into the insulating body 15 against the spring force of the plate spring 11, putting the metal cover 12 onto the insulating body 15, letting the push button 19P project out through the window 12W, and bending the lugs 12L of the metal cover 12 inwardly.

Depressing the push button 19P of the switch according to the present invention, the rotary actuator 19 turns about the rotary shaft portions 19S, causing the base portion 11D of the plate spring 11 to move toward the rear panel 15D. For example, letting the lengths of the level portion 19E and the retaining contact piece 11E be represented by L and the angle of rotation of the rotary actuator 19 from its horizontal position by $\phi$, the maximum distance of travel, $D_{MAX}$, of the base portion 11D is given by $D_{MAX}=2L(1-\cos\phi)$. With the movement of the base portion 11D, the movable contacts 11*a* and 11*b* also move toward the rear panel 15D by the same distance as that of the base portion 11D. When L is constant, a large distance of travel DMAX is obtained by increasing the angle of rotation $\phi$. This can be achieved by increasing the height of the center of the rotary shaft portion 19S from the inner bottom surface 15*f*.

FIGS. 2 and 3 illustrate push-ON type switches in which electric connections are established between the terminals 17A and 18A by depressing the push button 19P. To keep the fixed contact piece 18 in contact with the movable contact 11 at all times, the right-hand marginal edge of the fixed contact piece 18 is positioned nearer to the front panel 15C than the position where the movable contact piece 11 lies when the push button 19P is at its highest position (FIGS. 2A, 2B), and the left-hand marginal edge of the fixed contact piece 18 is positioned near the rear panel 15D so that the distance between the left- and right-hand marginal edges of the fixed contact piece 18 is sufficiently larger than the maximum distance of travel $D_{MAX}$. The width of the fixed contact piece 17 (in the front-to-back direction) is sufficiently larger than the maximum distance of travel $D_{MAX}$, and the fixed contact piece 17 is positioned apart from the front panel 15C so that when the push button 19P is at its highest position, the movable contacts 11*a* lie nearer to the front panel 15C than the fixed contact piece 17 and that when the base portion 11D is moved, for example, one half that of the maximum distance of travel $D_{MAX}$ by the depression of the push button 19P, the movable contacts 11*a* move onto the fixed contact piece 17 FIGS. 3A, 3B).

In the switch according to the present invention, since the movable contact pieces 11A and 11B and the retaining contact piece 11E are bent by the depression of the push button 19P in a manner to reduce the angle $\theta$ of the V-letter shape of the plate spring 11 (FIG. 6B), the effective length of the plate spring 11 that serves as a spring is the sum of the distance from the fixing hole 11*h* to the base portion 11D of the retaining contact piece 11E and the distance from the base portion 11D to the movable contacts 11*a* and 11*b*, providing a long effective length. Accordingly, no metal fatigue is likely to occur in the spring plate 11 even after the switch is actuated repeatedly, for example, tens of thousands of times.

In the present invention, the plate spring 11 is incorporated into the switch with the angle $\theta$ of the V-letter shape between the retaining contact piece 11E and the movable contact pieces 11A and 11B held small; the spring force of the plate spring 11 acts on the free end of the level portion 19 and the inn bottom surface 15*f* of the insulating body 15 in the direction in which to increase the angle θ of the V-letter shape, resiliently holding the push button 19P at its outermost position. To turn ON the switch, depress the push button 19P to bend the retaining contact piece 11E and the movable contact pieces 11A and 11B in a manner to reduce the angle θ between them. The resulting increased spring reaction force mostly serves to increase the contact pressure of the movable contacts 11*a* and 11*b* with the inner bottom surface 15*f* of the insulating body 15, but since the distance between the base portion 11D of the plate spring 11 and the center of the rotary shaft 19S undergoes substantially no change, the contact pressure between the base portion 11D and the inner bottom surface 15*f* hardly change. The base portion 11D need not be in touch with the bottom panel 15F but may be in light touch with it.

As described above, the pushbutton switch according to the present invention features a structure in which the tip end portion of the one arm (the fixed contact piece 11E) of the V-shaped plate spring 11, which turns and biases the rotary actuator 19 in the direction in which to let the push button 19P project out of insulating body 15, is engaged with the free end side of the lever portion 19E and the tips (that is, movable contacts 11*a* and 11*b*) of the other arms (the movable contact pieces 11A and 11B) are urged against the inner bottom surface 15*f* of the insulating body 15, applying resilient biasing force to the rotary actuator 19 by the reaction force from the inner bottom surface 15*f*. Another structural feature resides in that the center of rotation of the rotary actuator 19 is provided near the upper end of the insulating body 15 to convert the rotation of the rotary actuator 19 to rectilinear sliding motion of the movable contact pieces 11A and 11B.

Accordingly, the movable contacts 11*a* and 11*b* also slide on the inner bottom surface 15*f*. In the illustrated example, as the push button 19P is depressed, the movable contact pieces 11A and 11B slide leftward, by which the fixed contact pieces 17 and 18 embedded in the inner bottom surface 15*f* can be electrically connected to or disconnected from each other.

In the embodiment depicted in FIGS. 2 to 4, when the push button 19P is at its outermost position on the outside of the insulating body 15 as depicted in FIG. 2, the movable contacts 11*a* are held out of contact with the fixed contact piece 17 as shown. Pressing the push button 19P into the insulating body 15, the movable contact pieces 11A and 11B move leftward accordingly. As a result, the movable contacts 11*a* approach the fixed contact piece 17; and when the push button 19P is pressed into the insulating body 15 to a certain level, the movable contacts 11*a* slide into contact with the fixed contact piece 17 and onto them as depicted in FIGS. 3 and 4. Thus, when the push button 19P is pressed into the insulating body 15, electric connections are established between the fixed contact pieces 17 and 18 via the movable contact pieces 11A, 11B and the retaining contact piece 11E, making it possible to generate a contact signal across the terminals 17A and 18A.

Figure 7:
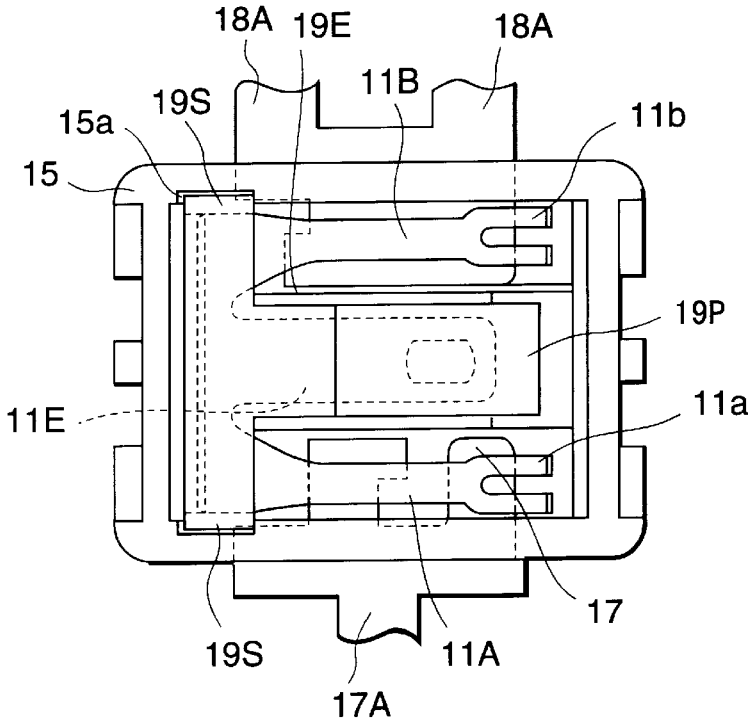
FIG. 7 is a plan view depicting a modified position of the fixed contact piece.

In the embodiment of FIGS. 2 to 4, the above the movable contacts 11*b* and the fixed contact piece 18 have been described to be in contact with each other at all times irrespective of whether and how much the push button 19 is pressed into the insulating body 15; however, as depicted in FIG. 7 corresponding to FIG. 2A, the right-hand marginal edge of the fixed contact piece 18 may be positioned in alignment with the right-hand marginal edge of the fixed contact piece 17 so that the movable contacts 11*b* slide onto the fixed contact piece 18 when the push button 19P is pressed into the insulating body 15. In this instance, there is provided between the terminals 17A and 18A a distance of electrical isolation that corresponds to the sum of the distance between each movable contact 11*a* and the fixed contact piece 17 and the distance between each movable contact 11*b* and the fixed contact piece 18 when the push button 19P is at its outermost position.

Figure 8:
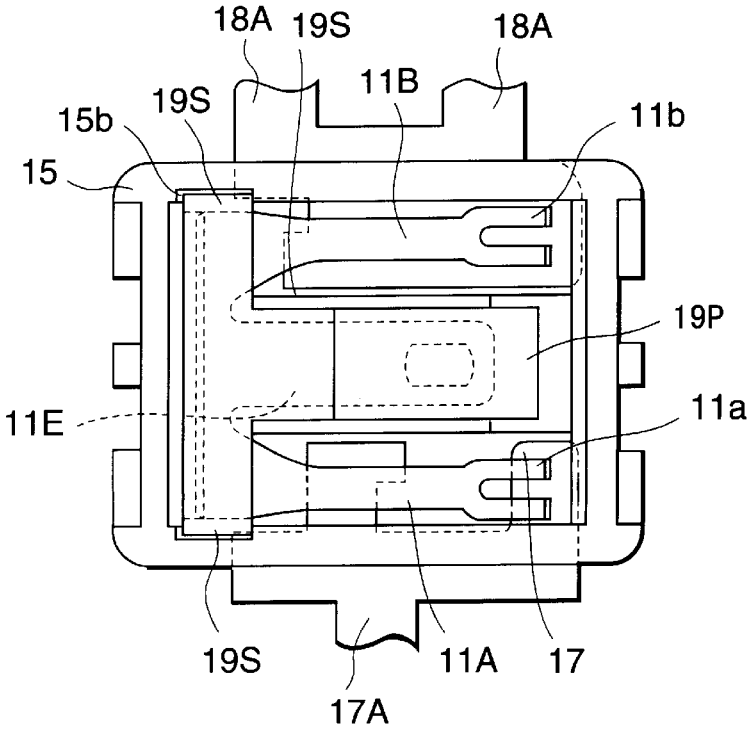
FIG. 8 is a plan view showing the position of the fixed contact piece of the pushbutton switch modified to the push-off type.

While in the above the present invention has been described as being applied to a switch of the type that turns ON when the push button 19P is depressed, the invention is also applicable to a switch that is turned OFF by the depression of the push button 19P. In this case, for example, as depicted in FIG. 8 corresponding to FIG. 2A, the fixed contact piece 17 is positioned near the front panel 15C so that it underlies the movable contacts 11A when the push button 19P is at its outermost position and that the movable contacts 11*a* move out of contact with the fixed contact piece 17 when the push button 19P is depressed. The fixed contact piece 18 may be of such a shape as shown in FIG. 2 but may also be changed to a shape symmetrical to that of the fixed contact piece 17 as depicted in FIG. 8.

In the above embodiments the cover 12 for covering the opening of the insulating body 15 has been described to be metal-made, but it may also be formed of synthetic resin. In such an instance, engaging protrusions need only to be provided which slightly protrude inwardly from the lower marginal edges of the front and rear panels 12C and 12D for engagement with external angles formed between the front and rear panels 15C, 15D and the bottom panel 15F of the insulating body 15.

EFFECT OF THE INVENTION

As described above, according to the present invention, the movable contact pieces 11A and 11B slide rectilinearly on the inner bottom surface 15*f* of the insulating body 15 with the rotation of the rotary actuator 19 by the depression of the push button 19P; at this time, the push button 19P needs only to be pressed down against the spring force of the plate spring 11 in such a manner as to reduce the angle θ between its retaining contact piece 11E and movable contact pieces 11A, 11B. Hence, the switch of the present invention can be turned ON and OFF with a light force. Moreover, since the effective length of the spring is about the same as the sum of the lengths of the retaining contact piece 11E and the movable contact pieces 11A and 11B, the amount of deformation of the spring per unit length can be kept small—this effectively prevents the possibility of the spring being broken by metal fatigue, making it possible to offer a highly durable pushbutton switch.

The pushbutton switch according to the present invention is intended for use as an "open" and "closed" position detector for small-sized electronic equipment such as a portable telephone or notebook PC, and the pushbutton has a body measuring approximately 3.8×3.0×1.8 mm, for instance. In the switch of this size, the maximum amount of travel of the movable contact pieces 11A and 11B is 0.4 mm when the push button 19P is pressed down to its lowermost or innermost position.

It will be apparent that many modifications and variations may be effected without departing from the scope of the novel concepts of the present invention.

What is claimed is:

1. A pushbutton switch comprising:

an insulating body molded of an insulating material and having a boxlike shape consisting of a pair of opposed side panels, a pair of opposed front and rear panels and a bottom panel, said insulating body having an opening at one end, and a pair of contact pieces to be electrically connected to and disconnected from each other being embedded in an inner bottom surface of said bottom panel of said insulating body;

a rotary actuator rotatably held at one end in said insulating body at a position higher than said inner bottom surface and carrying at another end a push button projecting outwardly of said insulating body;

a plate spring having a retaining contact piece engaged at one end with the another end of said rotary actuator and a movable contact piece for sliding at one end into or out of contact with said pair of fixed contact pieces on said inner bottom surface of said bottom panel of said insulating body, said retaining contact piece and said movable contact piece being coupled together at remaining ends thereof to form a V-letter shape, and said plate spring being disposed between said rotary actuator and said inner bottom surface of said bottom panel and resiliently biasing by reaction force from said inner bottom surface the another end portion of said rotary actuator in a direction in which to project out said push button from said opening of said insulating body; and a cover covering said opening of said insulating body but having a window through which said push button projects out of said insulating body.

2. The pushbutton switch of claim 1, wherein: said plate spring is formed by said retaining contact piece and two movable contact pieces coupled thereto at both side than to form a V-letter shape perpendicular to an axis of rotation of a rotary shaft of said rotary actuator; and at least one of said two movable contact pieces slides into and out of contact with one of said two fixed contact pieces.

3. The pushbutton switch of claim 2, wherein the other fixed contact piece is shaped such that the other movable contact piece stays in contact therewith at all times.

4. The pushbutton switch of claim 1, wherein said cover is a metal cover and has a substantially rectangular top panel with a window through which said push button projects out of said insulating cover, and two end panels extended from two opposed marginal edges of said top panel to cover said front and rear panels of said insulating body.

5. The pushbutton switch of claim 1, wherein said rotary actuator has rotary shaft portions at said one end, a rotary plate extending in the direction of an axis of rotation, a lever portion extending from said rotary plate at right angles thereto, and said push button is formed on said lever portion.

6. The pushbutton switch of claim 1, 2, or 3, wherein the movable contact piece has a bifurcated portion to provide movable contacts.

7. The pushbutton switch of claim 1, wherein bearing recesses are formed in upper end faces of said opposed side panels of insulating body for supporting said rotary shaft portions of said rotary actuator.

* * * * *